United States Patent [19]

Kennedy

[11] Patent Number: 4,973,416

[45] Date of Patent: Nov. 27, 1990

[54] LIQUID LAUNDRY DETERGENT IN WATER-SOLUBLE PACKAGE

[75] Inventor: Shaun P. Kennedy, Cincinnati, Ohio

[73] Assignee: The Procter & Gamble Company, Cincinnati, Ohio

[21] Appl. No.: 257,655

[22] Filed: Oct. 14, 1988

[51] Int. Cl.[5] ..... C11D 17/00

[52] U.S. Cl. ..... 252/90; 252/118

[58] Field of Search ..... 252/90, 118

[56] References Cited

U.S. PATENT DOCUMENTS

| | | | |
|---|---|---|---|
| 3,870,647 | 3/1975 | Travers | 252/118 |
| 4,416,791 | 11/1983 | Haq | 252/90 |
| 4,507,219 | 3/1985 | Hughes | 252/118 |

*Primary Examiner*—John F. Niebling
*Assistant Examiner*—Isabelle R. McAndrews
*Attorney, Agent, or Firm*—Richard C. Witte; Thomas H. O'Flaherty

[57] ABSTRACT

An article which is an aqueous liquid laundry detergent comprising from about 10% to about 24% by weight of water and a substantially organic neutralization system which is contained in a package, preferably a pouch or packet containing a unit dose of said liquid laundry detergent, said package comprising a water-soluble film-forming material that dissolves when placed in the laundry wash water so as to release the liquid laundry detergent, said water-soluble film-forming material being in substantially direct contact with the liquid laundry detergent, said film-forming material maintaining its structural integrity prior to addition to the laundry wash water due to the critical level of water in the liquid laundry detergent and use in the liquid laundry detergent of a substantially organic neutralization system.

7 Claims, No Drawings

LIQUID LAUNDRY DETERGENT IN WATER-SOLUBLE PACKAGE

BACKGROUND OF INVENTION

This invention relates to liquid laundry detergents in unit dosage form in a package comprising a water-soluble film-forming material.

The use of water-soluble film packages to deliver unit dosage amounts of laundry products is well known. Granular detergents and granular bleaches have been sold in this form on an irregular basis in the United States of America since about 1958.

A compact granular detergent composition in a water-soluble film pouch has been recently described in Japanese Patent Application No. 61-151032 (Lion Corporation), filed June 27, 1986. A paste detergent composition packaged in a water-soluble film is disclosed in Japanese Patent Application No. 61-151029 (Lion Corporation), also filed June 27, 1986. Further disclosures relating to detergent compositions which are either pastes, gels, or mulls packaged in water-soluble films can be found in Canadian Patent No. 1,112,534 (Pardo—Procter & Gamble) issued Nov. 17, 1981; and European Patent Applications Nos. 158464 and 234867 (Kaufmann et al—Clorox), published Oct. 16, 1985, and Sept. 2, 1987, respectively.

None of the above prior art disclosures relate to packaging a true, aqueous liquid laundry detergent, particularly a phase-stable, clear liquid laundry detergent, in a package of water-soluble film-forming material which is in direct contact with the liquid laundry detergent.

It is generally believed that liquid laundry detergents are incompatible with water-soluble films because of their water content. Thus, the attendant advantages of liquid laundry detergents over other forms of laundry detergents such as granules, pastes, gels, and mulls have not been available in water-soluble unit dosage form. The advantages of liquid laundry detergents over granules, pastes, gels, and mulls include their aesthetic appearance and the faster delivery and dispersibility of the detergent ingredients to the laundry wash liquor, especially in a cool or cold water washing process. A clear, isotropically stable liquid is particularly pleasing in appearance and appealing to consumers when packaged in a water-soluble film.

SUMMARY OF INVENTION

In accordance with the present invention, an article is provided for use in the laundry process which comprises a package made up of a water-soluble material in film form containing a liquid laundry detergent. More particularly, the article is an aqueous liquid laundry detergent comprising from about 10% to about 24% by weight of water and a substantially organic neutralization system which is contained in a package, preferably a pouch or packet containing a unit dose of said liquid laundry detergent, said package comprising a water soluble film-forming material that dissolves when placed in the laundry wash water so as to release the liquid laundry detergent, said water-soluble film-forming material being in substantially direct contact with the liquid laundry detergent, said film-forming material maintaining its structural integrity prior to addition to a laundry wash liquor due to the critical level of water in the liquid laundry detergent and use in the liquid laundry detergent of a substantially organic neutralization system.

The water-soluble package of this invention is preferably made from polyvinyl alcohol but can also be cast from other water-soluble material-s such as polyethylene oxide or methyl cellulose. Suitable water-soluble films are well known in the art and are commercially available from numerous sources.

The liquid laundry detergent for use in this invention is formulated in a manner which makes it compatible with the water-soluble film for purposes of packing, shipping, storage, and use. As stated herein before, compatibility of the liquid laundry detergent with the water-soluble film is achieved by the use of a critical water level in the liquid laundry detergent in conjunction with a substantially all organic (as opposed to inorganic) neutralization system. The liquid laundry detergent is a concentrated, heavy-duty liquid detergent which contains less than about 24% water and preferably less than about 18% water, expressed as a percentage by weight of the overall detergent composition. The neutralization system preferably comprises an alkanolamine which is selected from the group consisting of monoethanolamine, diethanolamine, triethanolamine, and mixtures thereof. Monoethanolamine is preferred. Other organic amines such as isopropanol amine, morphaline, etc. can be used although they are normally more expensive. Other amines can be used but preferably should have no, or minimal, odor.

Inorganic neutralizers are preferably not used in the liquid laundry detergents suitable for use in this invention in any substantial amount in order to ensure that the detergent remains clear, stable, and isotropic. Inorganic neutralizers include, for example, sodium and potassium hydroxides.

A solvent system which is comprised of an alkanol, for example, ethanol, and/or a polyol, for example, propylene glycol, which operates in conjunction with the water in the liquid laundry detergent can be used to enhance the compatibility of the liquid laundry detergent with the water-soluble film and to ensure the isotropic nature of the liquid laundry detergent. Conventional hydrotropes such as toluene, oxylene, and/or cymene sulfonic acids or their salts can also be used to improve the stability of the neutralized liquid laundry detergent in the presence or absence of a solvent system.

The preferred polyol in the solvent system is propylene glycol. Ethylene glycol or glycerine can be used as a partial or total replacement for propylene glycol. Isopropanol can be used in place of ethanol.

Water is used in the liquid laundry detergent in an amount less than about 24% by weight of the composition. A preferred amount is 18%. Reduction in the water content to below about 10% is possible; however, at a level of less than 10% the liquid laundry detergent will tend to absorb moisture through the vapor-permeable water-soluble film. This absorption of water can destabilize the liquid laundry detergent and/or lead to a breakdown in the water-soluble film.

The liquid laundry detergent package can be of any configuration but preferably has a rectangular or square shape when viewed normally to the plane of its two longest dimensions. A rectangular or square packet is more easily manufactured and sealed than other configurations when using conventional packaging equipment.

A peroxygen bleach capable of yielding hydrogen peroxide in the laundry wash liquor can be packaged in conjunction with the liquid laundry detergent. A bleach activator can be used, and is preferred, to increase the effectiveness of the peroxygen bleaching compound, especially under cool or cold water washing conditions. Such combinations of ingredients are disclosed in U.S. Pat. No. 4,412,934 (Chung et al—Procter & Gamble) issued Sept. 1, 1983. The configuration of the water-soluble package must be such that the bleach portion of the package is isolated from the liquid laundry detergent by being sealed, for example, in a separate discrete section of the package.

A most highly preferred package comprises a packet of polyvinyl alcohol film having one or more discrete separate sections which contain a phase-stable, clear liquid laundry detergent in a total amount suitable for washing a typical laundry load and, in one or more separate, but conjointly packaged, sections of said packet a suitable amount for washing a typical laundry load of a granular bleach, preferably peroxygen bleach, and optionally, but preferably, containing a bleach activator. A single unit dose packet will typically contain, for example, 30 grams to 50 grams of liquid laundry detergent and 20 grams to 35 grams of granular bleach. The granular bleach will generally be admixed with other ingredients such as sodium carbonate, polyethylene glycol, enzymes, etc. The total weight of the granular bleach plus these other ingredients will generally be from about 30 grams to 50 grams. Such a packet when manufactured by conventional means and having a single portion each of liquid laundry detergent and granular bleach typically measures approximately 8 cm to 20 cm, preferably 11 cm by 14 cm, in length and 5 cm to 20 cm, preferably 7 cm by 10 cm, in width and has a thickness of about 1 cm to 6 cm, preferably 2 cm by 3 cm. A packet of this type is ideally suited for home laundry use.

Packets of this size and weight are designed for use in the typical twin tub Japanese washing machine in which about 30 liters of water are used for washing. The packets can be up-sized for use in larger washing machines such as those used in the United States of America. For such larger machines, the packet weights and dimensions given immediately above can be multiplied by two. Alternatively, multiple packets of the smaller size can be recommended for use.

DETAILED DESCRIPTION OF INVENTION

Liquid laundry detergents suitable for use in this invention can contain an anionic surfactant, and/or an ethoxylated nonionic surfactant, a builder, an organic neutralization system, and a solvent system comprising water and, preferably, an organic solvent. Optional ingredients include enzymes, enzyme stabilizing agents, soil removal agents, antiredeposition agents, suds regulants, opacifiers, antioxidants, bactericides, dyes, perfumes, and brighteners. A complete description of optional ingredients can be found in U.S. Pat. No. 4,285,841 (Barrat et al—Procter & Gamble) issued Aug. 25, 1981.

These liquid laundry detergents contain a high level of active ingredients because of the low level of water content. Such compositions, because they also contain a builder, are generally referred to as "concentrated heavy-duty liquid laundry detergents". Concentrated heavy-duty liquid laundry detergents can be formulated to remove both particulate soils (such as clay soil) and greasy, oily stains. To meet the constraints of the present invention which include both phase stability of the liquid laundry detergent and, most importantly, the surprising compatibility of the liquid laundry detergent with the water-soluble film-forming material, the liquid laundry detergent requires an organic neutralization system and, optionally, an organic solvent system. The neutralization system is selected to provide a pH of less than 8.5, preferably less than 8.0, and, more preferably, about 7.5.

Suitable anionic surfactants include the water-soluble salts, particularly the alkali metal salts, of the sulfonated surfactants disclosed in the Barrat et al patent referred to above and U.S. Pat. No. 3,919,678 (Laughlin et al—Procter & Gamble) issued Dec. 30, 1975. These include the water soluble salts of the alkylbenzene sulfonates in which the alkyl group contains from about 8 to about 15 carbon atoms in a straight or branched chain configuration. Linear straight chain alkylbenzene sulfonates in which the average number of carbon atoms in the alkyl group is from about 11 to about 13 are particularly useful.

Ethoxylated nonionic surfactants are the preferred ingredients in the liquid laundry detergents for use in this invention. Suitable ethoxylated nonionic surfactants have the formula: $R^1(OC_2H_4)_nOH$, wherein $R^1$ is a $C_8$–$C_{18}$, preferably $C_{10}$–$C_{16}$, alkyl group or a $C_6$–$C_{13}$, preferably $C_8$–$C_{12}$, alkyl phenyl group, n is from about 3 to about 9, and said nonionic surfactant has an HLB (hydrophile-lipophile balance) of from about 10 to about 13.

Surfactants of this type are described in the Barrat patent referred to above and U.S. Pat. No. 4,284,532 (Liekhim et al—Procter & Gamble) issued Aug. 18, 1981. Particularly preferred nonionics are condensation products of: $C_{12}$–$C_{14}$ fatty alcohols with from about 3 to about 7 moles of ethylene oxide per mole of alcohol, e.g., $C_{12}$–$C_{13}$ alcohol condensed with about 6.5 moles of ethylene oxide per mole of alcohol.

A saturated fatty acid containing from about 8 to about 18, preferably from about 10 to about 14 carbon atoms is preferably included in the liquid laundry detergent. Such fatty acids can be obtained from natural sources or can be prepared synthetically. Examples include capric, lauric, myristic, coconut, and palm kernal fatty acids.

A builder, preferably a polycarboxylate builder, is utilized in the liquid laundry detergent. Examples of suitable polycarboxylate builders are disclosed in U.S. Pat. No. 1,739,942 (Echey—Procter & Gamble), issued Mar. 27, 1956, and U.S. Pat. No. 3,308,067 (Diehl—Procter & Gamble) issued Mar. 7, 1967. Especially suitable polycarboxylate builders include the following acids and their water-soluble salts: mellitic acid, citric acid, oxydisuccinic acid, and similar polycarboxylates.

A highly preferred ether carboxylate builder is disclosed in U.S. Pat. No. 4,663,071 (Bush et al—Procter & Gamble), issued May 5, 1987. These builders are mixtures of tartrate monosuccinate and tartrate disuccinate. One of the benefits of these builders is that they increase the specific gravity of the liquid laundry detergent and may thereby increase its compatibility with the polyvinyl alcohol film.

A suitable neutralization system for the liquid laundry detergents suitable for the use in the present invention contains from about 0.15 to about 0.19, preferably from about 0.17 to about 0.18, moles per 100 grams of detergent composition of an organic amine, preferably an analkanolamine, selected from the group consisting of monoethanolamine, diethanolamine, triethanolamine, and mixtures thereof. Monoethanolamine is preferred because it enhances product stability and detergent performance and has acceptable odor characteristics. As previously indicated, inorganic neutralization ingredients should be avoided. This includes, for example, not using sodium and/or potassium hydroxide.

The solvent system comprises water which, as discussed herein before, must be present in an amount less than about 24% by weight of the composition. A particularly suitable solvent system comprises ethanol and a polyol in addition to water. Ethanol is preferably present at a level of about 0.5% to about 10%, preferably from about 1% to about 5%, of the composition. Any polyol containing 2 to 6 carbon atoms and 2 to 6 hydroxy groups can be used. These polyols include ethylene glycol, propylene glycol, and glycerine. Propylene glycol is particularly preferred.

Stable liquid laundry detergents which can be modified for use in the present invention are disclosed in U.S. Pat. No. 4,507,219 (Hughes—Procter & Gamble) issued Mar. 26, 1985. The essential modifications to these compositions include the use of a lower than disclosed water content and a neutralization system which does not include any substantial amount of inorganic ingredients.

The granular bleach compositions which can be utilized in conjunction with the liquid detergent compositions are most preferably those disclosed in U.S. Pat. No. 4,412,934 (Chung et al—Procter & Gamble) issued Nov. 1, 1983. These compositions include peroxygen bleach compound capable of yielding hydrogen peroxide in an aqueous solution and a bleach activator having the general formula:

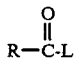

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 6 to about 13; wherein the molar ratio of hydrogen peroxide yielded by (a) to bleach activator (b) is greater than about 1.5.

Alternatively, granular preformed peroxygen bleaches, including peroxy carboxylic acid bleaches, can be used.

Suitable films and film-forming materials for packaging the liquid laundry detergents are rapidly and completely soluble or dispersible in water at temperatures above 5° C. These films/materials must be strong, flexible, shock resistant, and non-tacky during storage at both high and low temperatures and high and low humidities. Such films are readily available and include, by way of example, "Mono-sol"$^T$, sold by Mono-sol, a Division of Chris Craft International, Gary, Ind., U.S.A. Similar films which are compatible with the aqueous liquid detergent compositions of the present invention can be used. These films have a thickness of from about 0.5 mls to 5 mls, preferably from about 1 to 3 mls, and most preferably about 1.5 mls. Water-soluble films of this type are sealable by heat, heat and water, or ultrasonic sealing methods well known in the art.

The patent applications and patents referred to in the foregoing description of the present invention are incorporated herein by reference.

The following examples illustrate this invention. Unless otherwise stated, all parts, percentages, and ratios are by weight.

EXAMPLE 1

A liquid laundry detergent was prepared by admixing the following four premixes to provide a composition having a total water content of 16.29% by weight of the composition. The neutralization system is monoethanolamine. The solvent system comprises, in addition to water, propylene glycol. The pH of the composition was 8.35.

| Premix | Material/Identification | % Active | Parts |
|---|---|---|---|
| I | Soft water (3 g/gal.) | 100.00 | 4.76 |
| | Pentasodium diethylene triamine penta-acetate | 45.91 | 0.75 |
| | Monoethanolamine | 100.00 | 10.71 |
| II | Soft water (3 g./gal.) | 100.00 | 5.95 |
| | Citric acid | 100.00 | 3.48 |
| III | Soft water (3 g./gal) | 100.00 | 3.57 |
| | Propylene glycol | 100.00 | 16.37 |
| | Brighteners | 100.00 | 0.21 |
| IV | C11.8 HLAS | 95.19 | 31.00 |
| | Lauric($C_{12}$)/myristic($C_{14}$) fatty acids (3:1) | 100.00 | 9.77 |
| | Dobanol 91-8T (ethylene oxide condensate) | 100.00 | 6.94 |
| | Ethoxylated tetraethylene pentamine | 80.00 | 2.17 |
| | pH trim (MEA) | 100.00 | 4.00 |
| | Perfume | 100.00 | 0.30 |
| | | TOTAL | 100.00 |

The liquid laundry detergent was heat sealed in a packet of polyvinyl alcohol film having the thickness of 1.4 mls. The polyvinyl alcohol film was "Mono-sol"$^T$. The packet was approximately 12.9 cm long, 3.3 cm wide, and had a thickness of about 1 cm. The packet contained about 37.2 grams of liquid laundry detergent.

Approximately 20 packets prepared in the above manner (which were conjointly packaged with the granular bleach composition of Example 2) were divided into groups and stored at various constant temperatures between 25° F. (−4° C.) and 100° F. (38° C.) for three months. One group of packets was stored for a like period at 80% relative humidity and 80° F. (27° C.). In all cases, the liquid laundry detergent remained stable. The water-soluble performance characteristics of the polyvinyl alcohol film were not significantly affected during the storage period. In all cases, the packets dissolved in less than 90 seconds in 45° F. (7.2° C.) wash water.

EXAMPLE 2

A granular bleach composition was prepared containing the following components

| Material/Identification | Parts |
|---|---|
| Sodium perborate monohydrate | 49.7 |
| Sodium linear octanoyloxy-benzene sulfonate | 19.8 |
| Sodium carbonate | 28.8 |
| Polyethylene glycol | 1.0 |
| Enzyme ("Savinase"T - Novo Industries, Copenhagen, Denmark) | 0.7 |

This composition, when subject to the storage tests described in Example 1, did not adversely affect the performance characteristics of the polyvinyl alcohol film in which the granular bleach was conjointly packaged with the liquid laundry detergent of Example 1. Approximately 38.2 grams of granular bleach were packaged in conjunction with 37.2 grams of liquid laundry detergent in a discrete separate section of the polyvinyl alcohol packet, the granular bleach portion of the packet having dimensions substantially identical to those of the liquid laundry detergent portion of the packet.

The cleaning performance characteristics of these packets were tested in a typical Japanese twin tub washing machine (National—Model W102) using about 30 liters of wash water. These tests demonstrated cleaning performance superiority of the packet of this invention over both liquid and granular detergent products presently marketed in Japan.

Modifications in the components of Examples 1 and 2 can be made in accordance with the teachings of this invention which will not adversely affect their compatibility with the polyvinyl alcohol film package; for example, triethanolamine can be substituted for the monoethanolamine in Example I in an amount greater than 10% by weight of the liquid laundry detergent, most preferably greater than 14% but less than 28%. Ethanol can also be added in an amount which is greater than 0.5% by weight of the liquid laundry detergent but less than 10%. A preferred amount is 1% to 5%. A hydrotrope such as toluene sulfonic acid can be used in amounts identical to those specified for ethanol.

What is claimed is:

1. An article consisting essentially of (1) an aqueous liquid laundry detergent consisting essentially of from about 10% to about 24% by weight of water and a substantially organic neutralization system, and (2) a package for said aqueous liquid laundry detergent is in direct contact with the aqueous liquid laundry detergent.

2. The article of claim 1 in which the water-soluble film-forming material is polyvinyl alcohol.

3. The article of claim 1 in which the water content of the liquid laundry detergent is about 10% to about 18% by weight of the liquid laundry detergent.

4. The article of claim 1 in which the organic neutralization system in the liquid laundry detergent is an alkanolamine.

5. The article of claim 4 in which the alkanolamine is monoethanolamine.

6. The article of claim 4 in which the liquid laundry detergent is a solvent system of ethanol and propylene glycol.

7. The article of claim 1 conjointly packaged with a granular bleach.

* * * * *